US008689501B2

(12) United States Patent
Chamoux

(10) Patent No.: US 8,689,501 B2
(45) Date of Patent: Apr. 8, 2014

(54) GABION ELEMENTS FOR PRODUCING CONSTRUCTIONS SUCH AS WALLS, BARRICADES AND THE LIKE

(75) Inventor: Thierry Chamoux, Petange (LU)

(73) Assignee: Inoxys S.A., Petange (LU)

( * ) Notice: Subject to any disclaimer, the term of this patent is extended or adjusted under 35 U.S.C. 154(b) by 0 days.

(21) Appl. No.: 13/256,783

(22) PCT Filed: Mar. 15, 2010

(86) PCT No.: PCT/EP2010/053312
§ 371 (c)(1),
(2), (4) Date: Feb. 23, 2012

(87) PCT Pub. No.: WO2010/103128
PCT Pub. Date: Sep. 16, 2010

(65) Prior Publication Data

US 2012/0137598 A1 Jun. 7, 2012

(30) Foreign Application Priority Data

Mar. 13, 2009 (FR) ..... 09 51618

(51) Int. Cl.

| | |
|---|---|
| ***E04D 13/18*** | (2006.01) |
| ***E04H 14/00*** | (2006.01) |
| ***E02D 29/02*** | (2006.01) |
| ***E02D 31/00*** | (2006.01) |

(52) U.S. Cl.
CPC ..... *E02D 29/0208* (2013.01); *E02D 31/004* (2013.01)
USPC ..... 52/173.1

(58) Field of Classification Search
CPC ... E02D 29/0208; E02D 31/004; E02D 29/02; E02D 29/00; E02B 3/124; E02B 3/108; E02B 3/12; B65D 7/20
USPC ..... 52/155, 578, 581, 583.1, 592.6; 405/15–17, 302.4, 302.6
See application file for complete search history.

(56) References Cited

U.S. PATENT DOCUMENTS

| | | | | |
|---|---|---|---|---|
| 3,840,947 | A * | 10/1974 | Burbidge | 220/494 |
| 5,076,735 | A * | 12/1991 | Hilfiker | 405/284 |
| 5,333,970 | A | 8/1994 | Heselden | |
| 5,401,552 | A * | 3/1995 | Bohrer et al. | 428/87 |

(Continued)

FOREIGN PATENT DOCUMENTS

| | | | |
|---|---|---|---|
| DE | 4032966 | A1 | 4/1992 |
| DE | 4329370 | A1 | 3/1995 |

(Continued)

OTHER PUBLICATIONS

International Search Report for PCT/EP2010/053312 dated Jul. 5, 2010.

*Primary Examiner* — Mark Wendell
*Assistant Examiner* — Keith Minter
(74) *Attorney, Agent, or Firm* — Heslin Rothenberg Farley & Mesiti P.C.

(57) ABSTRACT

A gabion includes panels of metal meshes that can be assembled so as to form a casing for receiving a bulk of filler material such as pebbles, natural rock fragments, wood chips or the like and/or a mixture of said materials. The gabion further includes at least one flexible sealed pouch provided with gripping members and configured to be inserted between the assembled panels.

19 Claims, 10 Drawing Sheets

(56) References Cited

U.S. PATENT DOCUMENTS

Figure 1:
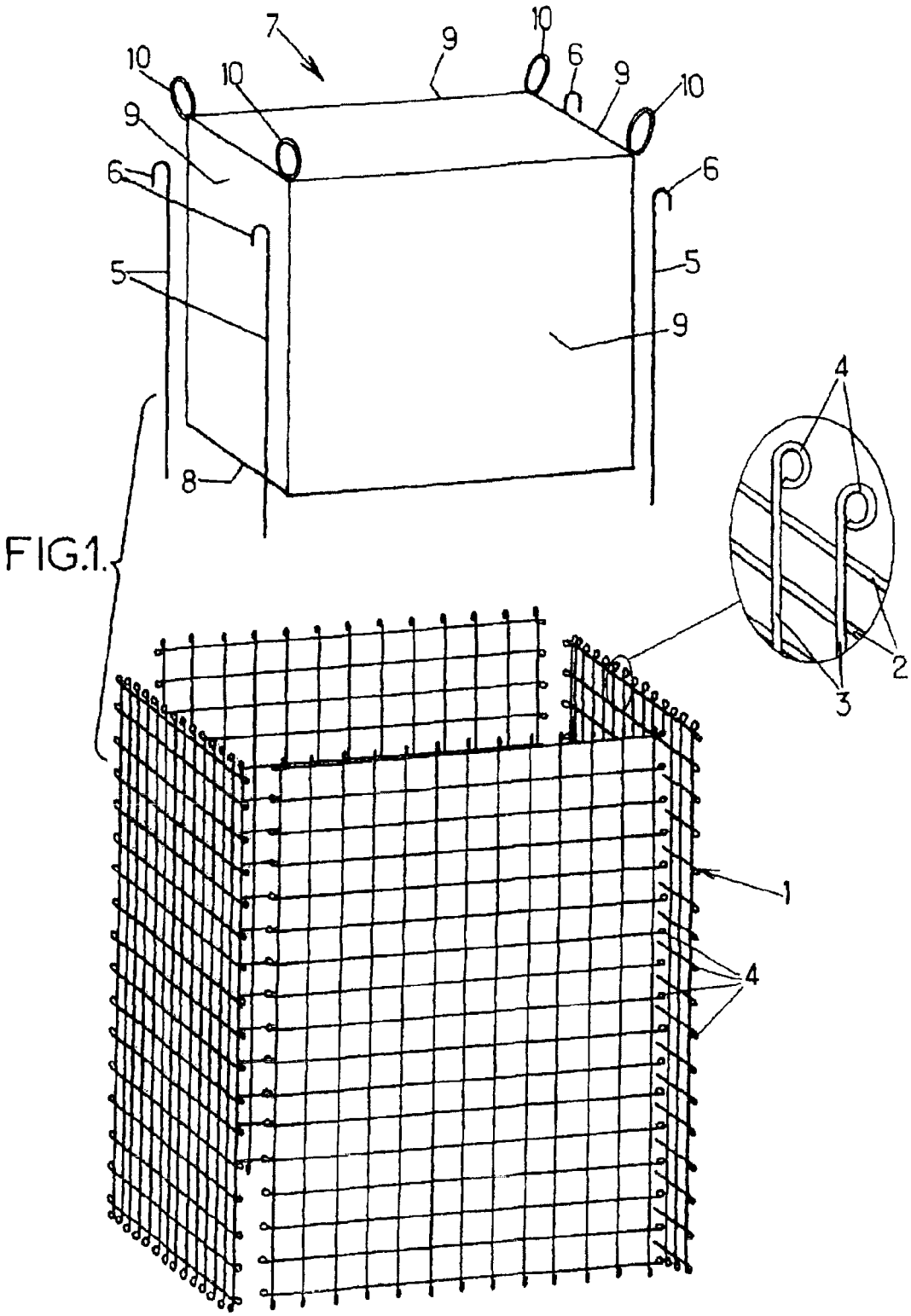

| | | | | |
|---|---|---|---|---|
| 5,472,297 | A | 12/1995 | Heselden | |
| 5,636,938 | A * | 6/1997 | Ragazzo | 405/15 |
| 5,647,695 | A * | 7/1997 | Hilfiker et al. | 405/284 |
| 5,860,551 | A * | 1/1999 | Knott, Sr. | 220/7 |
| 6,305,876 | B1 * | 10/2001 | Yoshino et al. | 405/17 |
| 6,857,817 | B2 * | 2/2005 | Rothfuss | 405/32 |
| 6,893,193 | B2 * | 5/2005 | Santha | 405/302.6 |
| D597,680 | S * | 8/2009 | Heselden | D25/4 |
| 7,837,414 | B2 * | 11/2010 | Heseldon | 405/284 |
| RE42,680 | E * | 9/2011 | Hilfiker et al. | 405/302.7 |
| 8,206,065 | B2 * | 6/2012 | Heselden | 405/284 |
| 8,262,318 | B2 * | 9/2012 | Olsta et al. | 405/129.65 |
| 2004/0218986 | A1 * | 11/2004 | Bottriell et al. | 405/302.7 |
| 2008/0247830 | A1 * | 10/2008 | Heselden | 405/273 |
| 2008/0264546 | A1 | 10/2008 | Olsta et al. | |
| 2009/0202308 | A1 * | 8/2009 | Heselden | 405/273 |
| 2010/0024343 | A1 * | 2/2010 | Eggermont | 52/648.1 |
| 2010/0064627 | A1 * | 3/2010 | Heselden | 52/745.09 |
| 2010/0143049 | A1 * | 6/2010 | Heselden | 405/284 |
| 2010/0166508 | A1 * | 7/2010 | Tanaka et al. | 405/276 |
| 2010/0172701 | A1 * | 7/2010 | Tucker et al. | 405/284 |
| 2010/0186642 | A1 * | 7/2010 | Christman et al. | 109/79 |
| 2011/0311755 | A1 * | 12/2011 | Crawford et al. | 428/68 |
| 2012/0134756 | A1 * | 5/2012 | Heselden | 405/273 |

FOREIGN PATENT DOCUMENTS

| | | | | |
|---|---|---|---|---|
| EP | 0197000 | A1 | | 10/1986 |
| FR | 788004 | A | | 10/1935 |
| FR | 2739881 | A1 | | 4/1997 |
| FR | 2862670 | A1 | | 5/2005 |
| FR | 2907480 | A1 | | 4/2008 |
| FR | 2917104 | A1 | | 12/2008 |
| GB | 2334739 | A | | 2/1998 |
| GB | 2438204 | A | | 11/2007 |
| GB | 2440449 | A | | 1/2008 |
| GB | 2493007 | A | * | 1/2013 |
| KR | 2007040872 | | * | 4/2007 |
| KR | 2007040872 | A | * | 4/2007 |

* cited by examiner

FIG.4.
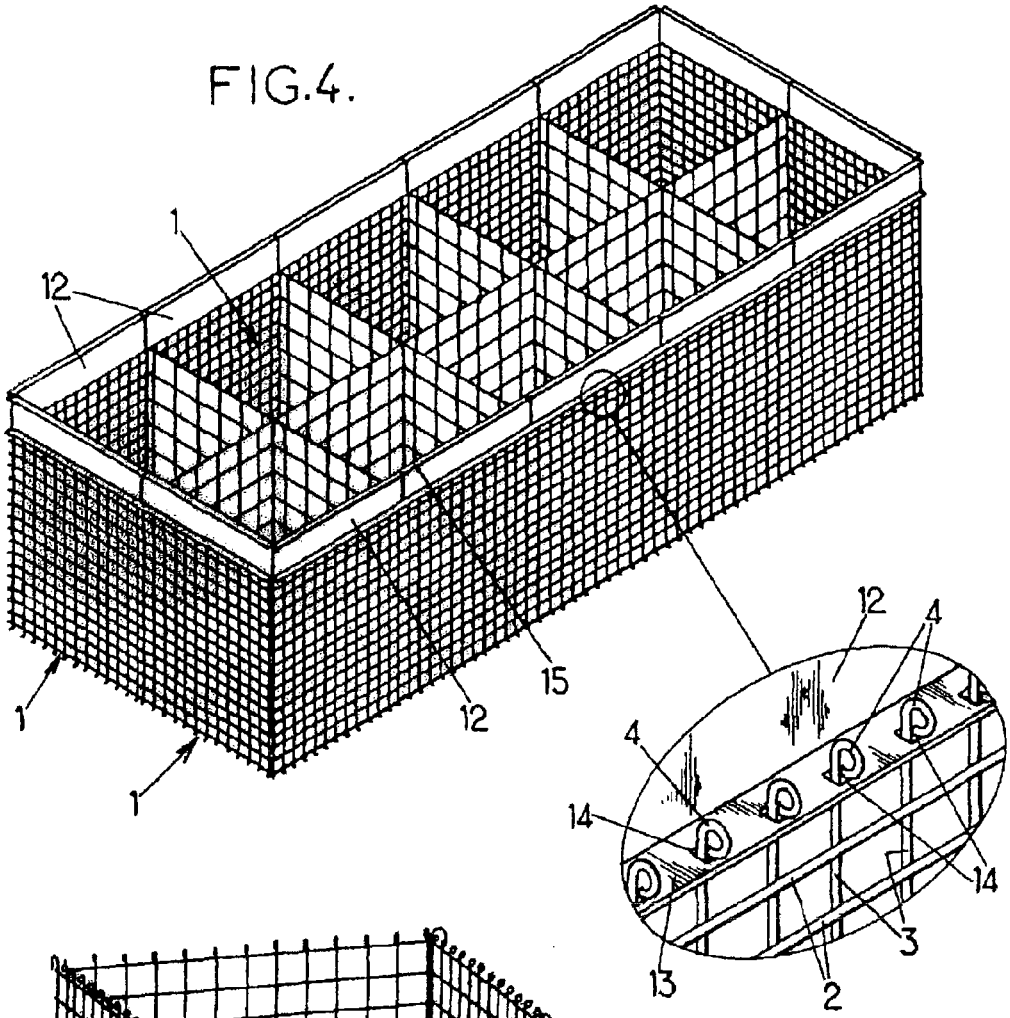
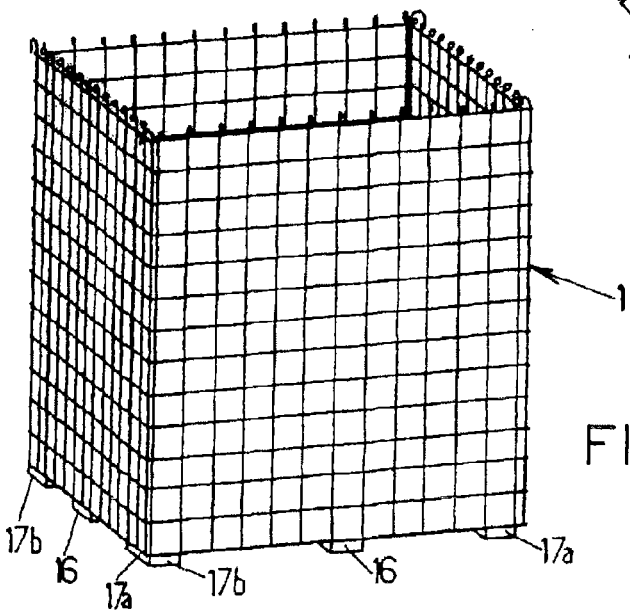
FIG.5.

Fig. 15
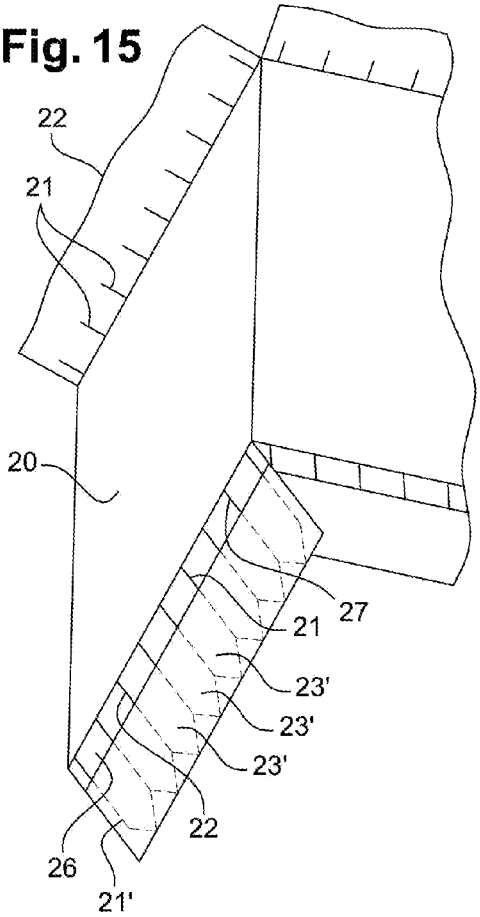
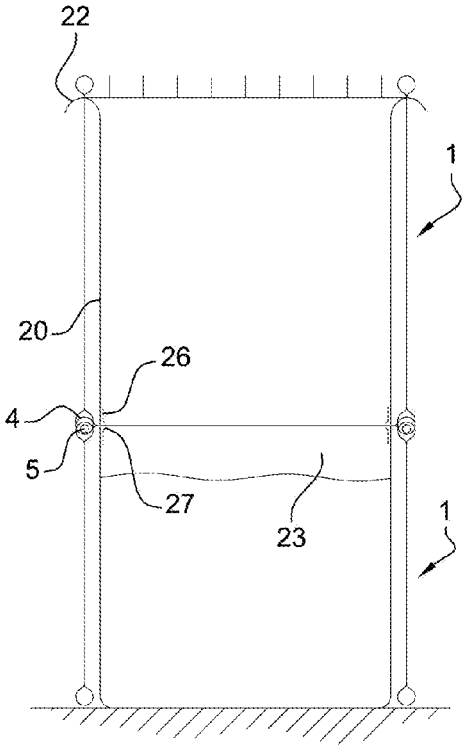
Fig. 16
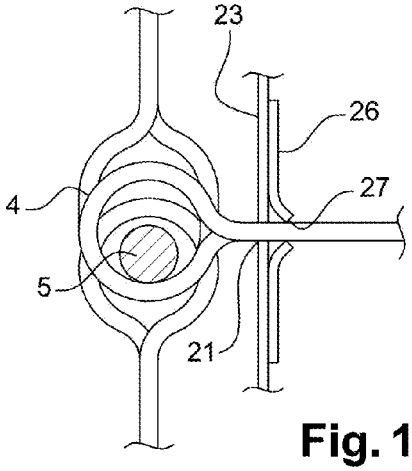
Fig. 17

GABION ELEMENTS FOR PRODUCING CONSTRUCTIONS SUCH AS WALLS, BARRICADES AND THE LIKE

CROSS REFERENCE TO RELATED APPLICATIONS

This application is a national stage filing under section 371 of International Application No. PCT/EP2010/053312 filed on Mar. 15, 2010, and published in French on Sep. 16, 2010 as WO 2010/103128 and claims priority of French application No. 0951618 filed on Mar. 13, 2009, the entire disclosure of these applications being hereby incorporated herein by reference.

THE INVENTION FIELD

The invention relates to a gabion including panels consisting of metal meshes that can be assembled so as to form a casing for receiving a bulk of filler material such as pebbles, natural rock fragments, etc. . . . for the construction of walls, retaining walls, barricades, decorative stone fences, noise-reduction barriers or all other similar civil works.

BACKGROUND OF THE INVENTION

It is well-known in the precast products field, commonly called gabions, for the construction of walls, retaining walls, barricades, decorative stone fences, noise-reduction barriers used particularly by landscape gardeners, and noise-reduction barriers in the track noise barriers' field or the like.

These gabions generally occur in panels consisting of metal meshes, constituting the vertical walls, the base and the lid, wherein said gabions are assembled one to another by means of metal spirals. These gabions usually have a significantly parallelepiped shape; however, they can have an ordinary shape. These gabions are usually built and filled with filler material such as pebbles, natural rock fragments, etc. . . . on site where they are used. They can also be pre-mounted and filled with embankments on a building site and then be transported to the place of use. The size of the backfilled materials exceeds the size of the mesh panels.

Incidentally, these gabions include a geotextile fabric positioned on the inner side of the mesh panels in order to allow the use of backfilled materials, whose size is smaller than the size of the metal mesh panels, but exceeds the size of the meshes of the geotextile fabric.

Such gabions are described in particular in the French patent FR 788 004. The gabion usually has a significantly parallelepiped shape and includes a metal mesh reinforcement to which the desired shape is obtained by a folding mechanism. The inner side of the reinforcement in metal meshes is topped with fillings, such as a fencing reed for example, capable of preventing the transfer of materials through the meshes of the iron lattice that are smaller than these meshes. Furthermore, other similar gabions are described in the French patent applications FR 2 862 670, FR 2 907 480 and FR 2 917 104, in the English patent application GB 2 334 739, in the European patent application EP 0 197 000, in the German patent application DE 4032966 and in the International patent applications WO 9633314 and WO 9012160.

The document US 2008/0264546 also describes a gabion including panels consisting of metal meshes assembled two by two, by welding, in order to form a casing for receiving a bulk of filtering and/or decontamination materials such as clean sediments, thin silt, sand and weighting materials like natural rock fragments and/or pebbles. The gabion includes a parallelepiped pouch obtained with geotextile fabric, a permeable fabric, in which are positioned the filtering and weighting materials. Preferably, the geotextile fabric contains reactive materials in order to capture pollutants.

The assembly of this type of gabion particularly long, places considerable strain on the construction costs of civil works executions that use these gabions.

In order to address these drawbacks, pre-assembled gabions providing a fast set up have already been imagined. It is the case for example concerning the gabions described in the American patents U.S. Pat. No. 5,333,970 and U.S. Pat. No. 5,472,297. Such gabions are made of building sites panels in open wire mesh connected edge-to-edge that can rotate and folded one on the other just like concertina. The side walls are connected by board panels, knowing that side walls are able to rotate relative to the board panels. The gabions thus form an adapted structure to be mounted on a building site by deploying it with a flexible rope to ensure that the deployed structure forms a series of gabions fit to be filled with filler materials. Favourably, the gabions contain a geotextile fabric secured on the inner side of the panels in order to allow a filling with a material whose size is smaller than the size of the panels meshes.

This kind of gabion structure has the disadvantage, besides being particularly expensive due to the complexity of the assembly, of not giving a sufficient modularity to execute civil works.

BRIEF DESCRIPTION OF THE INVENTION

One of the goals of the invention is to address these drawbacks by suggesting a simply-designed gabion made of panels in metal meshes, inexpensive, and that allows a fast and easy assembly on the place of use or on a building site, and an easy handling empty and/or filled with filler material.

To this end and in accordance with the invention, it is suggested a gabion made of panels in metal meshes that can be assembled so as to form a casing for receiving a bulk of filler materials such as pebbles, natural rock fragments, wood chips or the like and/or a mixture of said materials; wherein said gabion is characterized in that it comprises at least one flexible waterproof pouch provided with gripping means and capable of being inserted between assembled panels.

Such flexible pouch has a rather parallelepiped shape with a base, four lateral vertical walls and at least two handles that extend from the superior edge of two opposed lateral walls.

Incidentally, the flexible pouch contains a superior wall fitted with means of opening and closing.

Favourably, this flexible pouch is actually made of a chemically inert material and/or abrasion-proof and/or presenting a resistance to high temperatures.

Such flexible pouch is, preferably, made of a material that must contain at least one of the components chosen from the following list: silicone, nitrile, vinyl, plastic, polyurethane, perfluorinated polymer or their combinations.

Furthermore, such gabion includes at least three panels in metal meshes made of vertical and horizontal metal wires, whose respective free ends are curved in order to form rings capable of receiving a metallic core to assemble two adjacent panels.

Each ring expands in a plane perpendicular to the panel plane and the rings of a same edge of a panel are coaxial.

Preferably, such gabion contains at least four vertical panels assembled two by two, in order to form a parallelepiped block.

Favourably, the panels in metal meshes and/or the core are coated with a layer of chemically inert coating and/or abrasion-proof and/or having a resistance to high temperatures.

Such layer of chemically inert coating is made of a material that must contain at least one of the components chosen from the following list: silicone, nitrile, vinyl, plastic, polyurethane, perfluorinated polymer or their combinations.

Furthermore, at least two opposed panels have along their respective inferior edges at least two hoops in the shape of a U, the branches of the U extremities being attached to the inferior horizontal metal meshes of such panel and the hoops expanding in the same plan as the panel.

Preferably, each panel has along his inferior edge three hoops in the shape of a U, a central hoop expanding to the middle part of such inferior edge and two peripheral hoops expanding on both sides of the central hoop near the lateral edges of the panel.

Incidentally, such gabion contains at least one rigid panel known also as shuttering panel capable of being attached to the superior extremity of at least one panel of metal meshes so as it expands in continuity of the latter.

Such shuttering panel is folded along its inferior longitudinal edge in order to form a wing in which is a formed transversal rectangular slot, knowing that the rings of the superior free ends extremities of the vertical metal meshes are able to pass through such slot.

BRIEF DESCRIPTION OF THE DRAWING FIGURES

Figure 2:
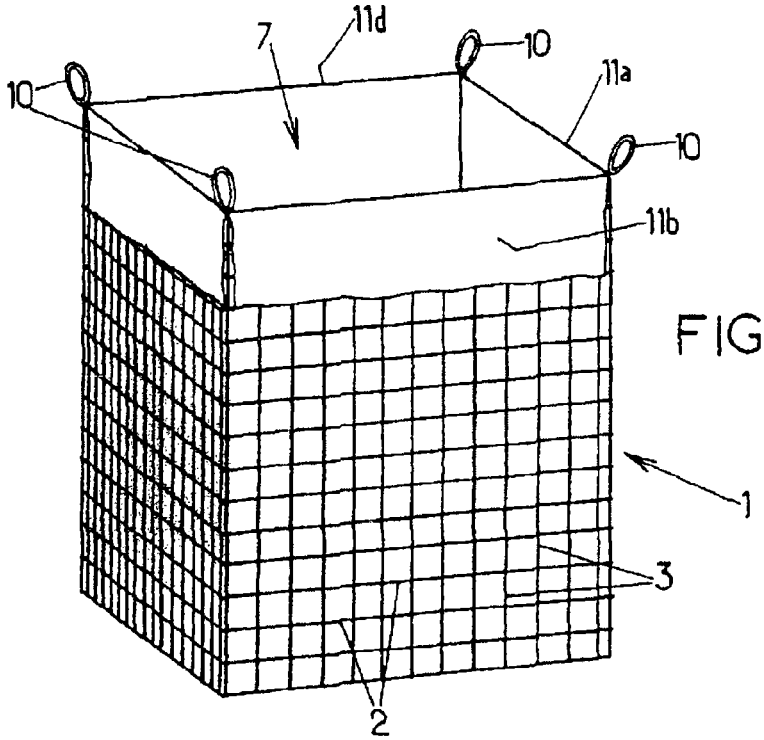
Figure 3:
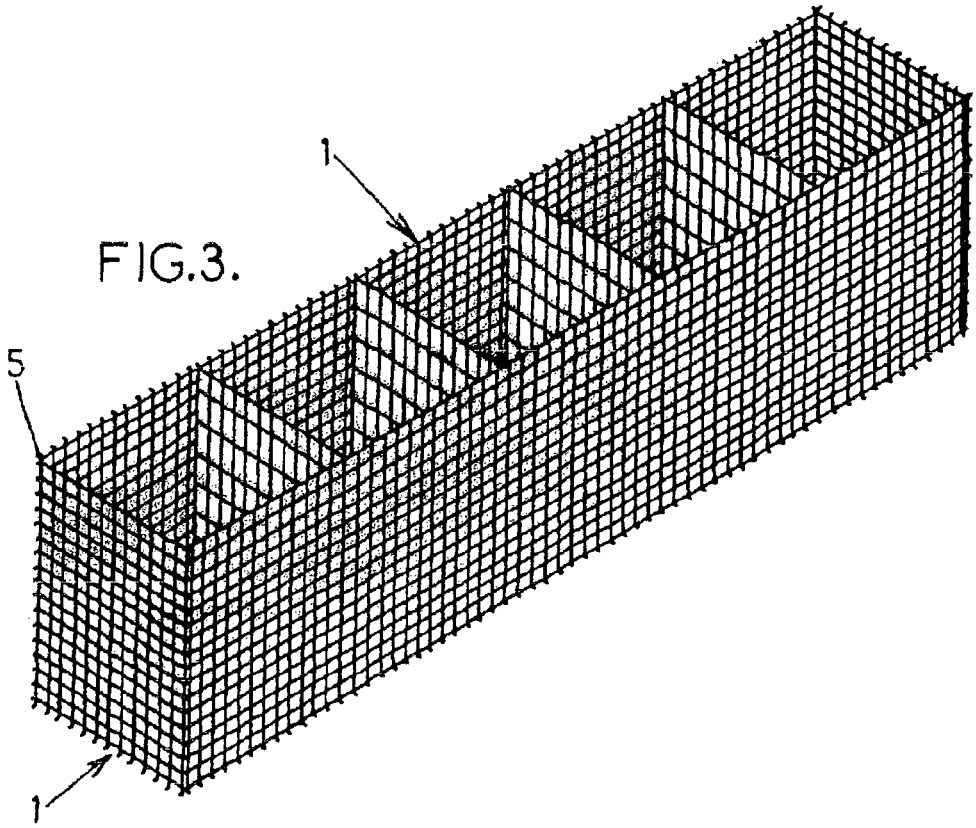
Figure 6:
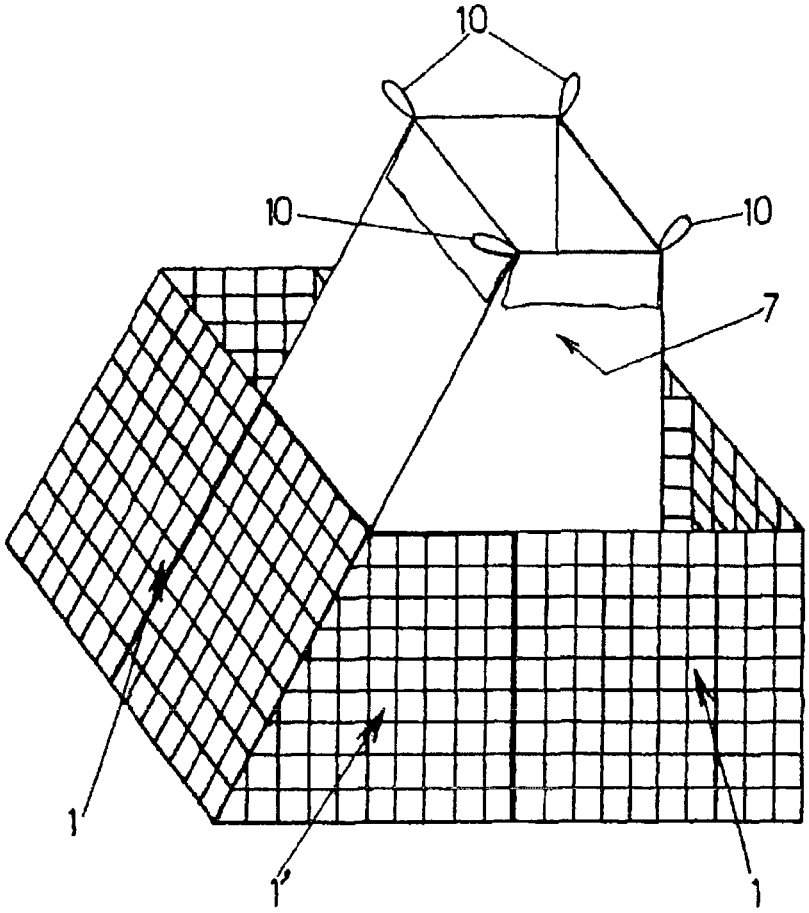
Figure 7:
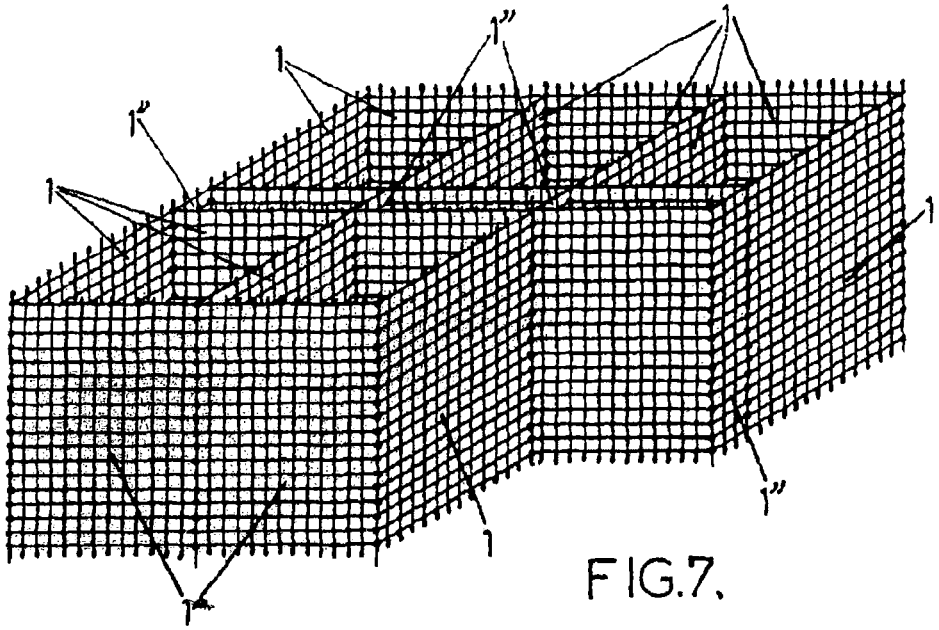
Figure 8:
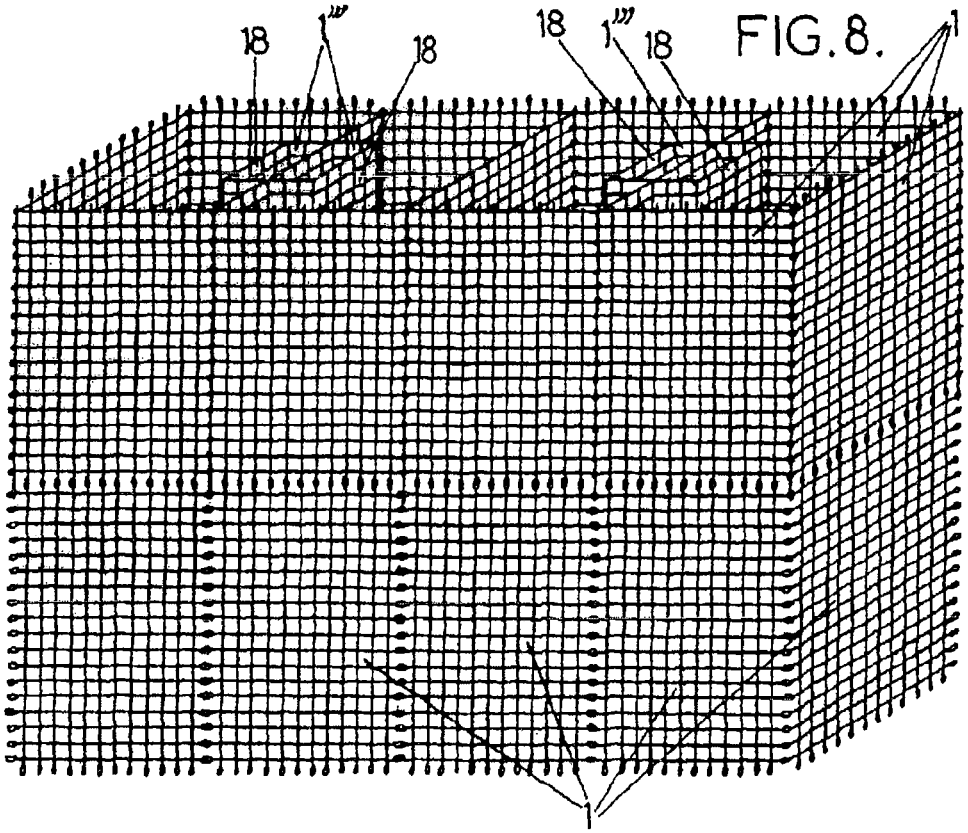
Figure 9:
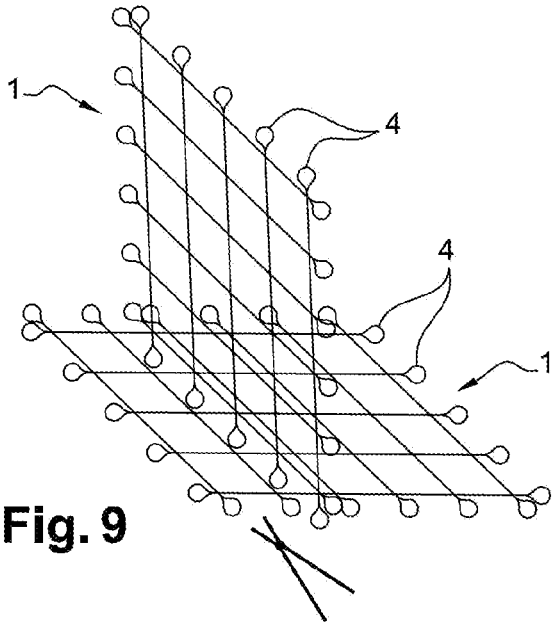
Figure 10:
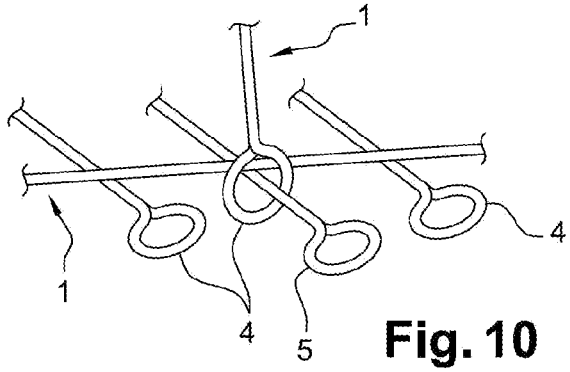
Figure 11:
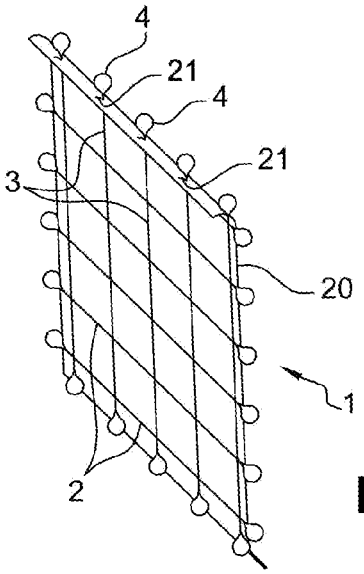
Figure 12:
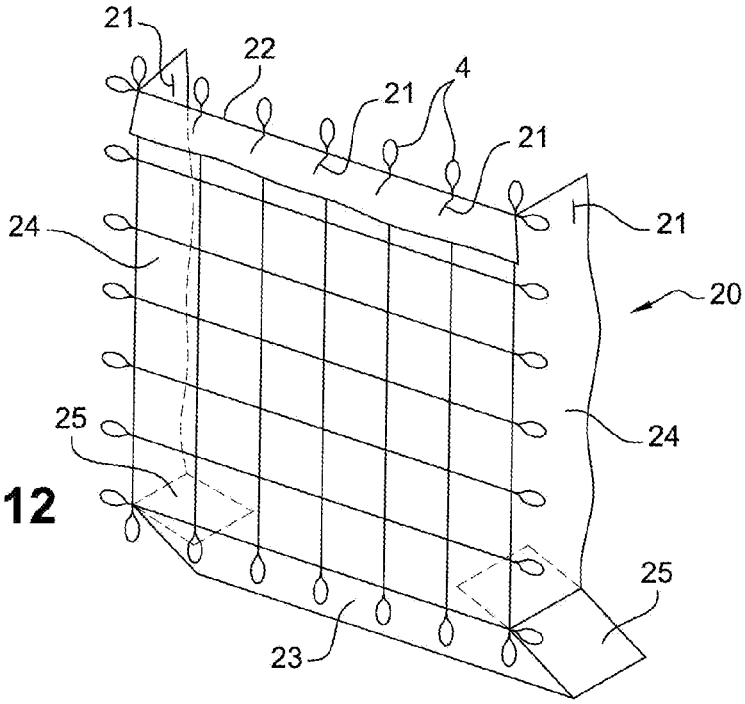
Figure 13:
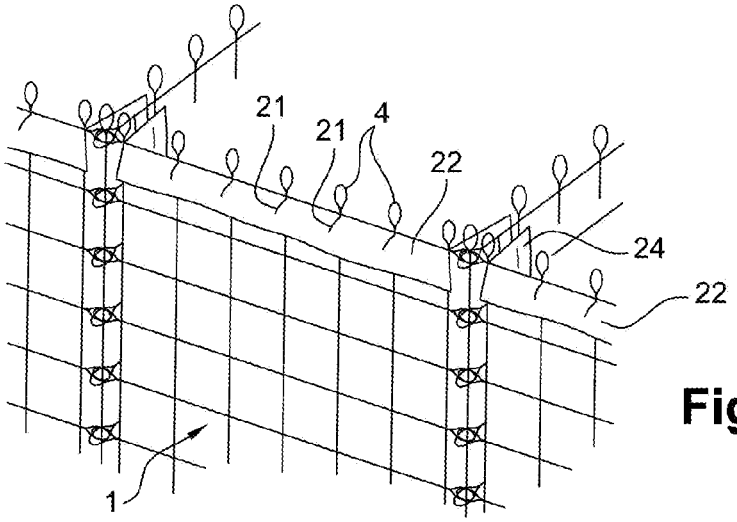
Figure 14:
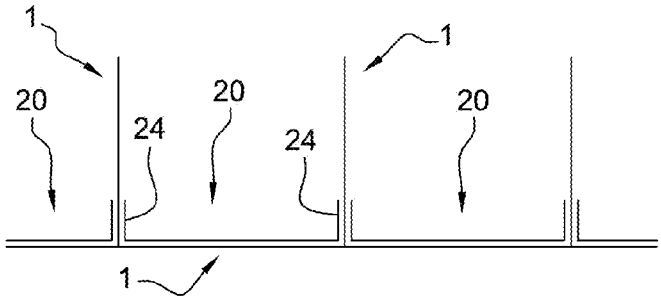
Figure 18:
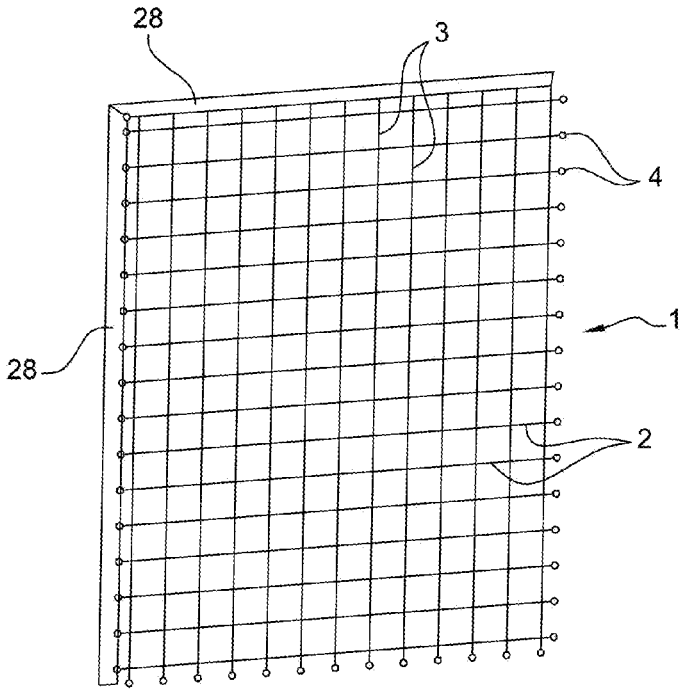
Figure 19:
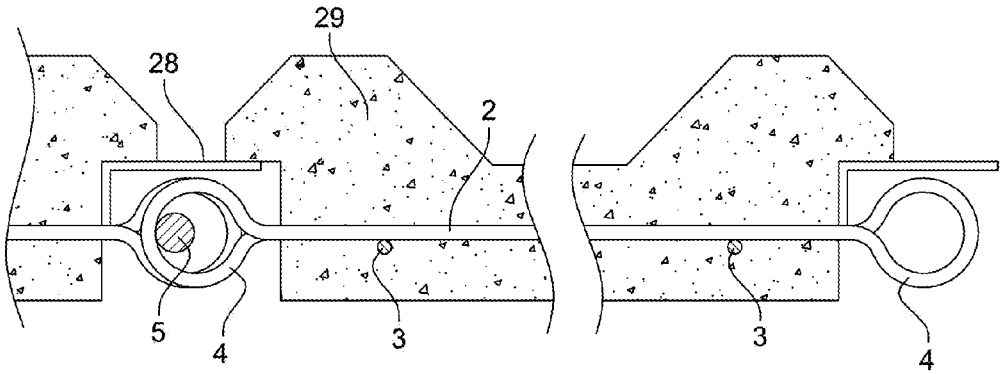
Figure 20:
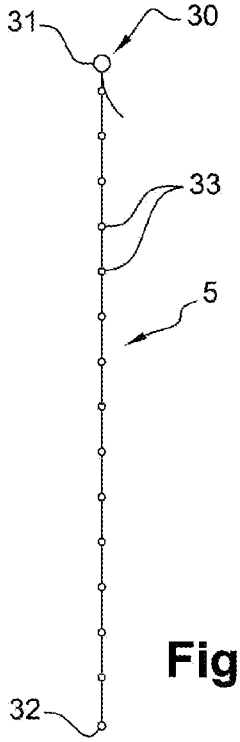
Figure 21:
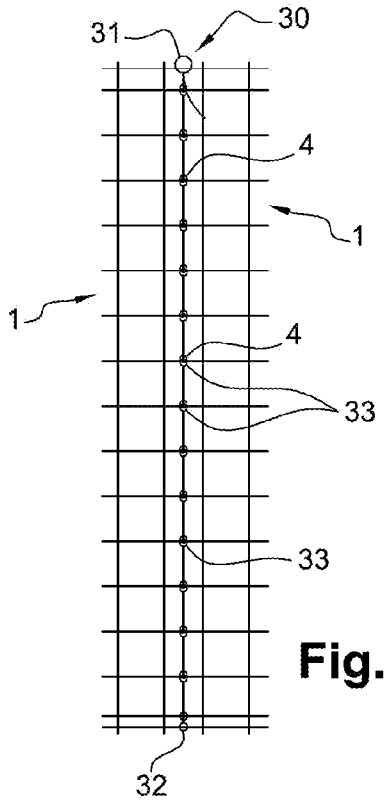
Figure 22:
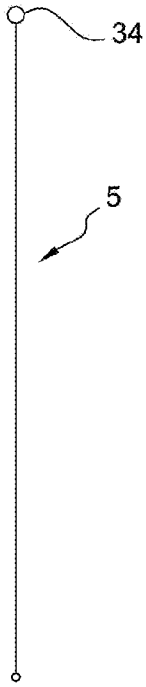
Figure 23:
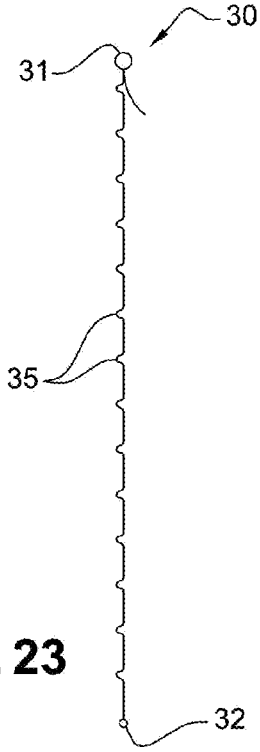

Other advantages and characteristics will bring better profile in the following description, of a few variations of execution, given as non-limitative examples, of the gabion compliant with the invention, in reference to the annexed drawings, on which:

FIG. 1 is an exploded view in perspective of a gabion compliant with the invention, FIG. 2 is a view in perspective of the gabion in accordance with the invention represented on FIG. 1, FIG. 3 is a view in perspective of an assembly of gabions compliant with the invention, FIG. 4 is a view in perspective of an assembly of gabions compliant with the invention and with the shuttering panels for the construction of a slab, FIG. 5 is a view in perspective of an implementing variation of the gabion compliant with the invention, FIG. 6 is a view in perspective of another implementing variation of the gabion compliant with the invention, FIG. 7 is a view in perspective of another implementing variation of an assembly of gabions compliant with the invention particularly intended for the construction of stabilised structures or noise-reduction barriers, FIG. 8 is a view in perspective of a last implementing variation of an assembly of gabions compliant with the invention, FIG. 9 is a view in perspective of an implementing variation of the gabion according to the invention, FIG. 10 is a view in perspective of a detail of the implementing variation of the gabion in accordance with the invention represented on FIG. 9, FIG. 11 is a view in perspective of the implementing variation of a panel in metal meshes of the gabion in accordance with the invention, FIG. 12 is a view in perspective of another implementing variation of a panel in metal meshes of the gabion in accordance with the invention, FIG. 13 is a partial view in perspective of gabions obtained by the assembly of panels in metal meshes represented on FIG. 12, FIG. 14 is a schematic top view of gabions represented on FIG. 13, FIG. 15 is a view in perspective of a piece of geotextile fabric covering a panel in metal meshes of the gabion compliant with the invention, FIG. 16 is a view in an elevated position of a stack up of gabions with pieces of geotextile fabric represented on FIG. 15, FIG. 17 is a view in an elevated position of a detail of the stack up of gabions represented on FIG. 16, FIG. 18 is a view in perspective of a last implementing variation of a panel in metal meshes of a gabion compliant with the invention, FIG. 19 is a sectional view of the implementing variation of a panel in metal meshes of a gabion in accordance with the invention, like represented in FIG. 18, filled with concrete, FIG. 20 is a side view of an implementing variation of a metallic core that enables the assembly of two adjacent panels in metal meshes of gabions compliant with the invention, FIG. 21 is a side view of the assembly of two panels in metal meshes of gabions compliant with the invention by means of a metallic core represented on FIG. 20, FIG. 22 is a side view of an implementing variation of a metallic core that enables the assembly of two adjacent panels in metal meshes of gabions compliant with the invention, FIG. 23 is a side view of another implementing variation of a metallic core that enables the assembly of two adjacent panels in metal meshes of gabions compliant with the invention.

DETAILED DESCRIPTION OF THE INVENTION

We will describe here after, as a non limitative example, a particular gabion designed for engineering works and construction such as tank dikes, with or without slab, noise-reduction barriers, decorative walls, etc. . . . ; However, there is no doubt that the gabion following the invention can also be used for the handling of raw or manufactured products without stepping outside the invention's frame.

As a reference to FIG. 1, the gabion following the invention is constituted of four rectangular panels 1 in metal meshes. Each vertical panel 1 in metal meshes is constituted of horizontal 2 and vertical 3 metal wires which respective free ends are bent to form rings 4. Each ring 4 extends itself in a plane perpendicular to the panel plane and the rings 4 of a same edge of a panel 1 are coaxial. The rings 4 are able to receive a metallic core 5, of circular cross-section, to assemble two adjacent panels 1. For example, the meshes of the panels 1 in metal meshes measure 10 cm×10 cm or 5 cm×5 cm.

The said rings 4 are preferably closed and have a globally circular shape as well as an inner diameter just inferior to the external diameter of the core 5.

However, it is obvious that the rings 4 may present a random shape and that the cores 5 may present a section of a corresponding shape without stepping outside the invention's frame.

The superior end of each core 5 is well bent to form a hook 6 constituting a stop so as, when the two adjacent panels 1 are mounted, the hook 6 will make contact with the ring 4 of the top horizontal core of one of the panel 1 in metal meshes.

In this particular example of realisation, represented on FIGS. 1 and 2, the gabion following the invention has four vertical panels 1 assembled two by two, by four cores 5, to form a parallelepiped.

Furthermore, the gabion includes as an advantage a flexible waterproof pouch 7, called <<big bag>> that is provided with gripping means and ready to be inserted between the assembled panels 1. The flexible pouch 7 has a parallelepiped shape that has a base 8, four lateral vertical walls 9 and four handles 10, e.g. hollow rings, extending to the four top corners of the said flexible pouch 7.

There is no doubt that the said flexible pouch 7 will only be able to include two handles 10 extending from the top edge of two opposed lateral vertical walls 9 without stepping out of the invention's frame.

Favourably, as a reference to FIG. 2, the flexible pouch 7 includes a top wall 11 constituted, for example, of four dampers 11*a*, 11*b*, 11*c*, and 11*d* equipped with opening and closing devices as fixing means and additional fixing means such as buckles and hooks forming a Velcro-type System® or any other equivalent mean well known by a person skilled in the art. That way, the dampers 11*a*, 11*b*, 11*c* and 11*d* are folded back on the external face of the panels 1 to enable the filling of the flexible pouch 7, the latter being filled with filler material such as pebbles, natural rock fragments, etc. . . . suitable depending on the purpose of the gabion. We will note that the dampers may be kept against the external face of the panels 1 by any suitable mean well known by a skilled person in the art, and, when the flexible pouch 7 is filled, the said dampers 11*a*, 11*b*, 11*c* and 11*d* will be folded back to close it.

There is no doubt that the dampers 11*a*, 11*b*, 11*c* and 11*d* may be left unfolded to leave the flexible pouch open depending on the purpose of the gabion compliant with the invention without stepping out of the invention's frame.

Incidentally, the flexible pouch 7 may be drilled by any perforating tool to allow drainage depending on the filler materials used and the purpose of the gabion.

As a reference, on FIG. 3, the elements of the gabion following the invention allow the realisation of an assembly of gabions disposed in line to form a protection wall, a decorative wall or a retaining wall, etc. . . . The panels 1 in metal meshes are assembled together by cores 5 in such a way that one panel 1 in metal mesh transversal separating two adjacent gabions is assembled to two panels 1 in metal mesh lateral with only one core 5. Thus, this assembly enables to save some panels in metal mesh in comparison with the anterior gabions. Indeed, the assembly of the gabion elements enables to remove the double transversal walls as well as the bases and the lids. Flexible pouches 7, not shown on FIG. 3, are then inserted in the gabions just formed and a filler material is introduced in the flexible pouches. In the same way, a new row of gabions can be formed on the former one next to the first one or slightly off-centre with the first row. The second gabion row is then put together with the first row thanks to cores 5 passing through the rings 4. The rings 4 of the bottom edge of the panels of the second gabion row had been previously positioned at right with the rings 4 of the top edge of the panel's second gabion row in such a way that the rings are coaxial.

Incidentally, as a reference to FIG. 4, the device following the invention includes a stiff panel called shuttering panel 12 ready to be put together to the top end of at least one panel 1 in metal mesh in such a way that it extends itself as an extension of the latter. The said shuttering panel 12 is a stiff steel plate that is folded on its low longitudinal edge to form a wing 13 in which are formed transversal rectangular slots 14. The rings 4 of the top free ends of the vertical wires 3 from the panel 1 in metal mesh are ready to be introduced through the so-called slots 14. The shuttering panel 12 is attached with panel 1 in metal mesh by introducing the rings 4 through the slots 14 and by introducing a core 5, not shown on FIG. 4, in the said rings 4.

To enhance the stiffness of the shuttering panels 12, these latter are well folded along their top longitudinal edge to form a second wing 15 extending itself on the same side as the first wing 13.

For example, the shuttering panels 12 are attached together with the top end of the lateral panels 1 in metal mesh forming the periphery of the gabion's assembly to allow (or not) the creation of a reinforced concrete screed, the gabions being previously filled with a filler material.

These shuttering panels' height will depend on the concrete screed's height since the shuttering panel's height is roughly equal to the screed's height. Thus, the said shuttering panels 12 may present a 13 cm or 20 cm height for example, depending on the purpose of the construction.

Furthermore, as a reference to FIG. 5, each panel 1 in metal mesh includes favourably along its inferior edge three hoops 16, 17*a* and 17*b* with a U shape, a central hoop 16 extending itself in the median part of the said inferior edge and two peripheral hoops 17*a* et 17*b* extending themselves on both sides of the central hoop 16 next to the lateral edges of panel 1 in metal mesh, the so-called hoops 16, 17*a* and 17*b* extending themselves in the same plane as the so-called panel 1. That way, the hoops 16, 17*a* and 17*b* heighten the gabion to allow some space to lifting means adapted to handling machines usually present on engineering construction sites such as the forks of a lifting machine, each fork being able to go under the gabion between a peripheral hoop 17*a* or 17*b* and the central hoop 16.

Considering a different way of action, not shown on the figures, at least two opposed panels 1 in metal mesh include along their inferior respective edges at least two hoops with a U shape, the ends of U branches' being attached with the inferior horizontal wire of the panel in metal mesh and the said hoops being extending themselves on the same plane as the panel. The so-called hoops are pulled away following the centre distance roughly equal to the centre distance of the lifting machine's forks and they have correct dimensions allowing the introduction of these forks in the rings.

Furthermore, as a reference to FIG. 6, the panels 1 in metal mesh may have a quadrilateral shape such as a square, a rectangle, a trapezoidal shape in order to realize gabions with varied and diverse shapes. In the realisation example represented on FIG. 6, we have represented a gabions' assembly including panels 1 in metal mesh, rectangular, and panels 1' in metal mesh with a rectangle trapezoidal shape, to create a bank with an inclined plane. The flexible pouch 7 then presents a shape corresponding to the realized gabions' shape, and after the gabions are filled with filler materials, the assembly thus realized is covered with earth for example.

It is obvious that the panels 1 and 1' in metal mesh may present various dimensions regarding the purpose of the gabions.

Considering a different way of action, as a reference to FIG. 7, the panels 1 in metal mesh are assembled in such a way to form two rows of gabions separated by spacers 1" constituted by panels in metal mesh of smaller dimensions. The so-called spacers have for example a 30 cm width. The so-called spacers 1" are constituted, in the same way as the panels 1 in metal mesh, of vertical and horizontal wires whose free respective ends are curved to form rings. Each ring 4 extends itself in a plane perpendicular to the panel plane forming spacer 1" and the rings 4 of the same edge of a spacer 1" are coaxial. Thus, the spacers are put together with the gabions' panels 1 in metal mesh by cores 5. The so-called gabions receive respectively a flexible pouch filled with filler materials and the spaces formed between the two gabions' rows and the spacers are filled with concrete, a steel reinforcement has previously been positioned on the so-called spaces in order to obtain reinforced concrete. Such a construction enables to set up stabilized structures or anti noise walls presenting high absorption properties in terms of acoustics while presenting a low porosity.

Considering a last different way of action, as a reference to FIG. 8, the panels 1 in metal mesh are mounted in order to form two rows of piled gabions, the inferior edge of the panels 1 in metal mesh of the superior row is put together with the superior edge of the panels 1 in metal mesh of the inferior row by cores 5 in cooperation with the corresponding rings of the so-called panels. Certain transversal panels 1 in metal mesh separating two adjacent gabions are substituted by panels 1''' in metal mesh including in their median part at least one shuttering element 18. Each shuttering element 18 consists in a folded metal mesh forming a U whose branches are put together, by welding for example, to the panels 1''' in such a way that this so-called shuttering element extends itself roughly from the inferior edge to the superior edge of the panel 1'''. In this particular example of setting up, each panel 1''' includes two shuttering elements extending themselves one facing to other, on both sides of the panel 1'''. The gabions receive flexible pouches 7, in the same way as previously, which are not shown on FIG. 8, filled with filler materials, and the shuttering elements 18 are filled with concrete, a steel reinforcement being preferably positioned in the shuttering elements in order to obtain reinforced concrete pillars that strengthen and stabilize the structure.

It is obvious that the concrete may be substituted by any other equivalent material such as mortar for example or any other mineral and/or synthetic grout without stepping outside the invention's frame.

Moreover, in a very favourable way, the flexible pouch 7 is obtained in a chemically inert material and/or abrasion-proof and/or resisting to high temperatures, over 30° C. Preferably, the so-called flexible pouch 7 is obtained in a material including at least one component chosen from the following list: silicone, nitrile, vinyl, plastic, polyurethane, perfluorinated polymer or their combinations. In addition, the panels 1, 1',1''' and the spacers 1'' in metal mesh and/or the cores 5 are coated with a layer of chemically inert coating and/or abrasion-proof and/or having a resistance to high temperatures, over 30° C. Such layer of chemically inert coating is made of a material that must contain at least one of the components chosen in the following list: silicone, nitrile, vinyl, plastic, polyurethane, perfluorinated polymer or their combinations. This way, the gabions following the invention may be used to set up structures suited to retain contaminated water or chemical effluents and also structures suited to resist sustainably in aggressive environments.

We will note that the flexible pouches 7 may be obtained from natural and/or synthetic fibres, woven or not, coated or not, and they may favourably be treated to be ultraviolet resistant and/or coated with a protection layer chemically inert and/or abrasion-proof and/or resistant to high temperatures without stepping outside the invention's frame.

In order to enhance the esthetical aspect and to protect the flexible pouches 7 against external aggressions such as ultraviolet (UV) of the structures following the invention, the latter may be favourably strapped with panels 1 in metal mesh, the strapping being made around ten centimeters away from the gabions' panels 1 in metal mesh, then a filler material with a better visual aspect, such as round pebbles, is introduced between the strapping panels and the gabion's panels. This way, the round pebbles obscure the flexible pouches 7 from the gabions enhancing significantly the visual aspect of the whole construction and protecting it against UV.

It is obvious that the panels 1 in metal mesh may present different dimensions regarding the purpose of the gabions.

As a reference to FIGS. 9 and 10, the panels 1 in metal mesh may be mounted together two by two by introducing the rings 4 from the ends of the mesh's wires 2 between the meshes of the second panel 1 and by introducing a core 5 in the so-called rings 4. Then, the part of the panel 1 that is not used may be removed by using a bolt-cutter 19 or equivalent. This way, it will possible to create structures in panels 1 in metal mesh having a great modularity in terms of dimensions and shapes, such as an arc for example.

In addition, the gabion following the invention may only be constituted by four rectangular plan panels 1 in metal mesh without a flexible pouch. In the same way as previously, each vertical panel 1 in metal mesh is constituted of horizontal wires 2 and vertical wires 3 whose respective free ends are curved to form rings 4. Each ring 4 extends itself in a plane perpendicular to the panel plane and the rings 4 of a panel 1's same edge are coaxial. The so-called rings 4 are suited to receive a metallic core 5, of circular cross-section, to assemble two adjacent panels 1.

Favourably, as a reference to FIG. 11, each panel 1 in metal mesh may include a rectangular piece of geotextile fabric 20 whose transversal, superior and/or inferior edges have notches 21, the rings 4 of the vertical wires 3's superior free ends of the panel 1 in metal mesh being suited to be introduced through the so-called notches 21 to maintain the piece of geotextile fabric 20 against the panel 1's internal wall.

It is obvious that the piece of geotextile fabric may include notches 21 along only one of its edge or along its four edges without stepping outside the invention's frame.

Considering another way of action compliant with the invention, as a reference to FIGS. 12 to 14, each piece of geotextile 20 includes transversal flaps, inferior 22 and superior 23, equipped with notches 21 and longitudinal flaps whose inferior and/or superior edge is also fitted with at least one notch 21 suited to receive a ring 4 from the superior free end of a vertical wire 3 from an adjacent panel 1 in metal mesh forming a cross panel. Incidentally, the longitudinal flaps 24 include favourably dampers 25 suitable to be folded back on the so-called flaps 24. These pieces of geotextile 20 fabrics enable the filler materials such as earth, sand, etc. to be maintained.

Moreover, as a reference to FIGS. 15 to 17, the pieces of geotextile 20 fabric are favourably equipped with a reinforcement band 26 having notches 27 extending itself at right of the notches 21 on the geotextile fabric at the level of the inferior transversal flaps 23. This reinforcement band 26 is preferably stiff or semi-stiff and stapled or glued on the inner face of the geotextile piece 20. This reinforcement band 26 gives a better waterproofing next to the notches 21 of the geotextile piece 20 to avoid a leak of the gabion's filler materials. We will note that, when the gabions are piled up, referring to FIG. 16, the inferior transversal flap 23 caps the superior part of the geotextile piece of fabric of the inferior gabion ensuring a waterproofing between the superior and inferior gabions.

It is obvious that the reinforcement band 26 may also be obtained in a flexible material and fixed by any appropriate mean known by a person skilled in the art on the inner face of the piece in geotextile fabric 20 without stepping outside the frame of the invention.

In addition, regarding another way of action, as a reference to FIG. 15, the notches 21 of the inferior transversal flap 23 are substituted by cuts 21', represented in dotted lines, forming fringes 23' with pointed ends. In this alternative way of action, the reinforcement band 26 is useless. The width of each fringe 23' is roughly the same to the gap between two vertical cores 2 or horizontal 3 of a panel 1 in metal mesh.

Regarding a last alternative way of action, as a reference to FIGS. 18 and 19, each panel 1 in metal mesh includes along its two adjacent sides at least, one longitudinal side and one transversal side, a joint 28 constituted by a transversal section metal rod with an L shape whose one branch is welded to the ends of the horizontal wires 2 and respectively vertical 3, capping the rings 4. These joints 28 enable to create a wall without holes nor empty spaces during the assembly of the different panels 1 when a concrete shell 29 or a composite shell is implemented on each panel 1 (FIG. 19).

In addition, as a reference to FIGS. 20 and 21, the metallic core 5 allowing the assembly of two panels 1 in metal mesh favourably includes on its superior end a clip 30, obtained by the folding of the metallic core 6, whose circular head 31 has a diameter superior to the rings 4 in which the core 5 is introduced during the assembly of the panels, and on its inferior end a ring 32 whose external diameter is just inferior to the inner diameter of the rings 4 of the panels 1. This way, when the gabions are loaded with materials, the core 5 can not be removed, as well as the ring 32 at the inferior end of the core 5 forming a stop. Incidentally, the core 5 includes cavities 33 that are obtained by the crushing of the core for example, evenly distributed along the core 5. The spacing between the cavities and the spacing between two horizontal cores 2 or vertical 3 of a panel in metal mesh is roughly the same. Regarding a different way of implementation of the core 5, as a reference to FIG. 22, the latter includes in its superior end a ring 34, instead of a clip 30, whose external diameter is superior to the inner diameter of the rings 4 of the panels in metal meshes and, in its inferior end, a ring 32 whose external diameter is just inferior to the inner diameter of the rings 4 of the panels 1.

Regarding a last way of implementation of the core 5, as a reference to FIG. 23, the latter includes in the same way as before in its superior end a clip 30, obtained by the folding of the metallic core 6, whose circular head 31 has a superior diameter in comparison with the diameter of the rings 4 in which the core 5 is inserted during the assembly of the panels, and in its inferior end a ring 32 whose external diameter is just inferior to the inner diameter of the rings 4 of the panels 1. The core is different from the one described on FIG. 20 since the cavities 33 have been substituted by corrugations 35.

Finally, it is obvious that the examples that have been given are only particular illustrations. There are neither complete nor limited regarding the scope of the invention.

The invention claimed is:

1. Gabion including panels of metal meshes assembled so as to form a casing for receiving a bulk of filler material and at least one flexible waterproof pouch inserted between the assembled panels and having handles available for lifting the pouch whether the pouch is open or closed;

wherein the flexible pouch has a parallelepiped shape including a base, four lateral vertical walls, and two hollow handles extending from a superior edge of two lateral opposed walls.

2. Gabion according to claim 1, wherein the flexible pouch includes a superior wall with opening and closing means.

3. Gabion according to claim 1, wherein the flexible pouch comprises material resistant to abrasion.

4. Gabion according to claim 3, wherein the flexible pouch comprises a material including at least one of: silicone, nitrile, vinyl, plastic, polyurethane, perfluorinated polymer, and their combinations.

5. Gabion according to claim 1, including at least three panels of metal meshes constituted of horizontal wires and vertical wires whose respective free ends are curved to form rings receiving a metallic core to assemble two adjacent panels.

6. Gabion according to claim 5, wherein each ring extends in a plane perpendicular to a plane of the panel.

7. Gabion according to claim 5, wherein the rings along a same edge of a panel are coaxial.

8. Gabion according to claim 5, including at least four vertical panels assembled two by two to form a parallelepiped shape.

9. Gabion according to claim 5, wherein at least one of the panels of metal meshes and the core are at least one of coated with a layer of material having a property selected from the group consisting of: chemically inert, abrasion-proof, and temperature resistant.

10. Gabion according to claim 9, wherein the layer of chemically inert material comprises a material containing at least one of: silicone, nitrile, vinyl, plastic, polyurethane, perfluorinated polymer, and their combinations.

11. Gabion according to claim 1, wherein each of at least two opposed panels have along respective inferior edges at least two hoops in the shape of a U, extremities of branches of the U being attached to an inferior horizontal metal wire of a respective panel and the hoops extending in a same plane as the respective panel.

12. Gabion according to claim 11, wherein each panel includes, along an inferior edge, three U shaped hoops, including a central hoop expanding to a middle part of the inferior edge and two peripheral hoops expanding on both sides of the central hoop near lateral edges of the panel.

13. Gabion according to claim 1, further comprising at least one rigid shuttering panel attached to a superior extremity of at least one panel of metal meshes extending in continuity of the at least one panel.

14. Gabion according to claim 13, wherein the shuttering panel is folded along an inferior longitudinal edge in order to form a wing including transverse rectangular slots, and wherein rings at extremities of the superior free ends of the vertical metal wires of the panel in metal mesh pass through said slots.

15. Gabion according to claim 1, wherein the flexible pouch comprises a chemically inert material.

16. Gabion according to claim 1, wherein each lateral vertical wall of the flexible pouch includes a top damper that is folded back on an external face of a respective panel for gabion filling and folded in to form a top wall of the gabion, and each handle is independent of each damper.

17. Gabion according to claim 16, wherein each handle is located at a corner of the pouch.

18. Gabion according to claim 1, wherein each handle is ring-shaped.

19. Gabion according to claim 18, wherein each handle is located at a corner of the pouch.

* * * * *